United States Patent [19]

Hafner et al.

[11] Patent Number: 4,482,093

[45] Date of Patent: Nov. 13, 1984

[54] FUEL INJECTION NOZZLE FOR INTERNAL COMBUSTION ENGINES

[75] Inventors: Martin Hafner, Leonberg; Karl Hofmann, Remseck; Josef Schlagenhauf, Esslingen; Gerhard Stumpp, Stuttgart; Dietrich Trachte, Kornwestheim, all of Fed. Rep. of Germany

[73] Assignee: Robert Bosch GmbH, Stuttgart, Fed. Rep. of Germany

[21] Appl. No.: 386,377

[22] Filed: Jun. 8, 1982

[30] Foreign Application Priority Data

Jul. 1, 1981 [DE] Fed. Rep. of Germany ..... 3125884

[51] Int. Cl.³ ..... F02M 47/00

[52] U.S. Cl. ..... 239/73; 239/533.3; 73/119 A

[58] Field of Search ..... 239/71, 73, 533.3–533.12, 239/585; 137/554; 251/139, 141; 339/275 R, 276 F, 276 T; 73/119 A

[56] References Cited

U.S. PATENT DOCUMENTS

| | | | |
|---|---|---|---|
| 4,273,409 | 6/1981 | Blanche et al. | 339/276 T |
| 4,331,317 | 5/1982 | Kamai et al. | 239/585 |
| 4,340,181 | 7/1982 | Stumpp et al. | 239/533.3 |
| 4,362,050 | 12/1982 | Stumpp et al. | 73/119 A |
| 4,362,051 | 12/1982 | Schlagenhauf | 73/119 A |

FOREIGN PATENT DOCUMENTS

| | | | |
|---|---|---|---|
| 2932480 | 2/1981 | Fed. Rep. of Germany . | |
| 2069043 | 8/1981 | United Kingdom | 239/533.3 |

*Primary Examiner*—John J. Love
*Assistant Examiner*—James R. Moon, Jr.
*Attorney, Agent, or Firm*—Edwin E. Greigg

[57] ABSTRACT

A fuel injection nozzle for internal combustion engines, provided with a valve needle and an induction coil, which sits in a spacer plate mounted between the nozzle body and the nozzle holder. The valve needle projects into the induction coil and acts upon the magnetic domain of the induction coil by the action of its movement, whereby a signal dependent on the velocity of the needle is produced. The induction coil is provided with laterally disposed contact prongs which are connected with extended connecting wires by means of a weld or solder joint. The connecting wires lead through boreholes in the nozzle holder. The injection nozzle is distinguished by an especially small electrical line resistance, and by the fact that, with appropriate dimensioning and construction of the ends of the connecting wires, which carry the extended connection contacts, there will be no special contact measures necessary for disassembly.

16 Claims, 6 Drawing Figures

FUEL INJECTION NOZZLE FOR INTERNAL COMBUSTION ENGINES

BACKGROUND OF THE INVENTION

The present invention relates to a fuel injection nozzle for internal combustion engines. The nozzle is of the type including a nozzle body tensioned against a nozzle holder, into which nozzle body a valve needle is introduced. The valve needle is loaded by a locking spring disposed in a chamber in the nozzle holder. The end of the valve needle opposite to the nozzle opening end is inserted in an induction coil which is mounted between the nozzle body and a nozzle holder. The induction coil is provided with two laterally disposed contact prongs which are electrically connected with extension connecting contacts by means of contact wires extending through the nozzle holder.

In fuel injection nozzles of this sort, the valve needle acts on the magnetic domain of the induction coil by means of its velocity, according to which a signal depending on the needle velocity is produced, for example, for a device that ascertains and assesses the beginning of the fuel injection operation and the length of injection operation.

A fuel injection nozzle of this kind has already been suggested, in which the spring cushioned contact prongs of the induction coil press directly against the spot facings of connecting wires that are secured with free play in boreholes in the nozzle holder and securely connected to connecting contacts on the nozzle holder. In these previously known injection nozzles, the electrical conducting connections of the induction coil are open in the area of the tangent plane of the nozzle holder and the spacer plate, so that the nozzle body, for the purpose of adjusting the valve needle opening pressure, for instance, can be removed from the valve holder without any special provisions for contact between them, and it is possible then to fit the nozzle body together with the nozzle holder again. In the previously known injection nozzles, however, special care must be taken for the correct positioning of the connecting wires in the nozzle holder boreholes, as well as with the front face of the nozzle holder facing the spacer plate, to assure a sufficiently high contact pressure between the component parts. In addition, it has already been suggested that two studs connected by wires with the induction coil winding be provided on the facing side of the spacer plate turned toward the nozzle holder, and that in addition, two cooperating contact elements be mounted coaxially with flexible free play in the nozzle holder. This embodiment is relatively expensive, particularly as it will be necessary to solder both the spacer plate and the nozzle holder for assembly.

OBJECT AND SUMMARY OF THE INVENTION

It is an object of the present invention to provide an improved fuel injection nozzle of the type noted previously.

The design according to the present invention has the advantage over the prior art that a very small contact resistance between the contact prongs of the induction coil and the extended connecting wires is assured independently of location deviations, resulting from weld or solder joints on the induction coil contact prongs. The injection nozzle can, nevertheless, still be disassembled without any provisions for contact, if the extended connecting contact is not secured to the nozzle holder, but is instead merely disposed at the ends of the connecting wires and may be removed through the boreholes accomodating the connecting wires or through slits in the nozzle holder, or if, according to one of the embodiments, the ends of the connecting wires are projecting out of the nozzle holder to such an extent that the nozzle holder can be lifted away from the spacer plate at a sufficient distance to allow disassembly of the locking spring.

A reliable mechanical and electrical connection exists when the induction coil prongs are provided with contact studs welded onto the free ends, and by means of the contact studs the connecting wires are joined by means of a solder.

Preferably, each of the studs may have an insulation sheath either welded or glued onto it. The insulation sheaths, with their facing sides opposite and turned away from the prongs, are seated against a collar ring in the nozzle holder. The collar ring, fitted around the borehole, is provided for the pertinent connecting wires. In this manner, it is assured that the insulation sheath will both serve as a strain relieving agent for the weld or solder joints on the prongs and connecting wire, as well as sealing the hollow space accommodating the prongs and studs between the nozzle holder and the spacer plate against the boreholes in the nozzle holder, which carry the connecting wires and are open to the air.

For purposes of sealing, it is also possible to additionally provide, for further advantage, a flexed bracket, which at one of its ends is supported on a shoulder surface of the nozzle holder, and at its other end is axially tensioned against elastic stopper slugs by means of a screw. The stopper slugs each with a connecting wire are each supported on a close-tolerance surface on the nozzle holder. The close-tolerance surface surrounds the lead-through borehole for the connecting wire.

A faultless seal between the nozzle holder and the spacer plate is produced, if the spacer plate is provided with exit channels leading from the junction points of the prongs, and for the purpose of accommodating the connecting wires, the exit channels skirting the close-tolerance edges or close-tolerance surfaces set into the aperture rim of the nozzle holder chamber and leading into the open space or depression clearance in the spacer plate. The open spaces or depression clearances correspond to and overlapping with the lead-through openings for the connecting wires in the nozzle holder.

The connecting wires can be easily fitted into the spacer plate channels during preassemly of the spacer plate, if the clearances overlapping with the lead-through boreholes in the nozzle holder are designed as longitudinal slots around the circumference of the casing.

In this case, strain relief for the connecting wire weld or solder joints with the contact prongs can also be realized without any additional design features, if the channels in the spacer plate join together in an acute angle in the extended longitudinal slots on the spacer plate casing circumference.

Assembly of the fuel injection nozzle can be simplified, if the junction points for the connecting wires are located together with the prongs on the side of the prongs opposite the nozzle body. In this case, the induction coil can be fitted into the spacer plate before connecting it with the connecting wires, and then subsequently secured by means of, for example, an adhesive. In this way, the spacer plate forms a holding device for the induction coil when the connecting wires are being soldered or welded. In addition, a perfect encapsulating seal for the junction points will be considerably facilitated by means of insulation sealing compound.

A secure connection between the connecting wires and the induction coil contact prongs will be realized if each of the contact prongs is provided with a curved weld or solder elongation leading off the prong surface upward, preferably to one of the open eyelets opposite the channels.

In this way, an accidental grounding on the close tolerance washer due to dripping solder will be avoided, if the coil body is provided with insulating flange attachments that fasten the laterally displaced prongs from under and against the close tolerance washer.

When the prong junction points, which are recessed in the spacer plate facing surface, are sealed together with the connecting wires, the junction points will not prevent subsequent surface treatment, for example, by lapping.

It would be of especial advantage, if the coil body were provided with a ring collar protruding axially over the prongs, whose facing side would preferably not be in the plane of the sections of the facing side surface of the close tolerance washer that are not recessed.

BRIEF DESCRIPTION OF THE DRAWINGS

Three specific examples of the preferred embodiment of the invention are represented in the drawings and are explained in more detail in the following description.

DESCRIPTION OF THE PREFERRED EMBODIMENTS

Figure 1:
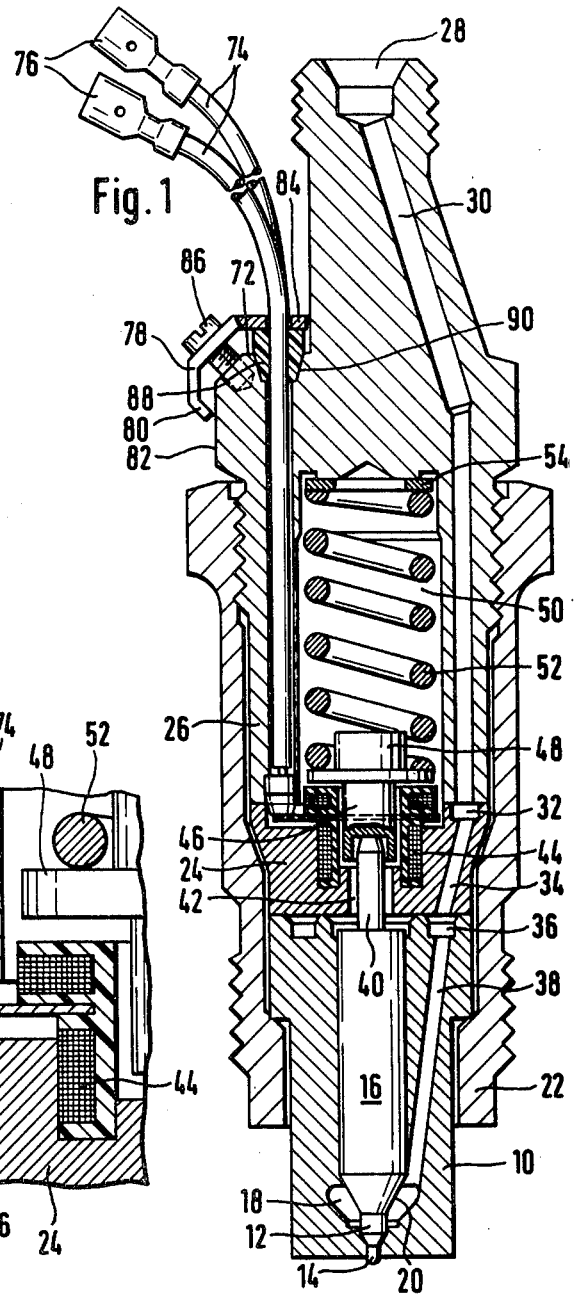
FIG. 1 shows an enlarged lengthwise section through one preferred embodiment.
Figure 2:
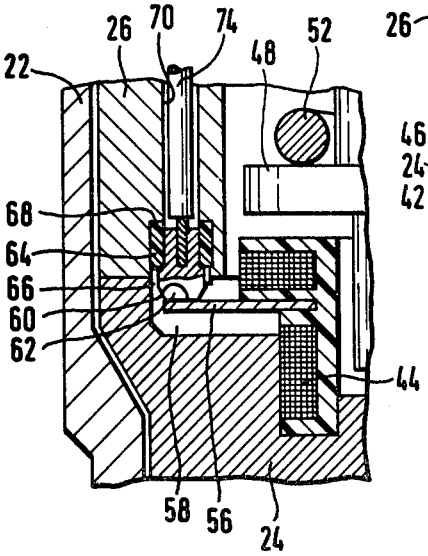
FIG. 2 shows a component subsection of the fuel injection nozzle according to FIG. 1, but in contrast to FIG. 1, to an enlarged scale.

The fuel injection nozzle according to FIGS. 1 and 2 has a nozzle body 10, in which a valve seat 12 is defined adjacent to a nozzle opening 14. The valve seat 12 is controlled by a valve needle 16, which is mounted in the nozzle body 10 in such a fashion that it may slide back and forth. The valve needle 16 is provided with a pressure collar 20 in the area of the pressure space 18 located upstream from the valve seat 12. The nozzle body 10 is tightened onto a nozzle holder 26 by means of a union nut 22 connected over a spacer plate 24. Fuel flows into a localized recess 32 in the upper facing side of the spacer plate 24 from a channel 30 leading from a connection borehole 28 in the nozzle holder 26. The spacer plate 24 is connected with a ring nut 36 in the upper facing side of the nozzle body 10 over a borehole 34. An index pin, which is not visible in the drawing, assures that the components are in correct position with respect to one another during assembly. A channel 38 leads from the ring nut 36 into the pressure space 18 of the nozzle body 10.

The valve needle 16 is provided with an extension 40, which is smaller in cross sectional area, and which extends through a borehole 42 in the spacer plate 24 and projects into the central opening of an induction coil 44. The induction coil 44 is mounted in a borehole in the spacer plate 24 which is larger in cross sectional area and held tight there by a bonding agent. Lying on the extension 40 of the valve needle 16 is an extension 46 of a transmitting thrust member 48 projecting into the induction coil 44; the transmitting thrust member 48 extends, as well, into a chamber 50 in the nozzle holder 26. In the chamber 50, there is a locking spring 52 for the valve needle 16. The locking spring 52 engages the transmitting thrust member 48 and engages at its other end a spacer plate 54 of determined strength.

The induction coil 44 is provided with two spring-cushioned connection-contact prongs 56, which are laterally disposed at some distance from the induction coil 44 at an approximately right angle to the nozzle axis. The prongs 56 extend into a radial recess 58 in the upper facing side of the spacer plate 24 (FIG. 2). A mushroom-shaped stud 62 has been welded onto the free ends 60 of each of the prongs 56, and an insulation sheath 64 has been attached to the outside of these studs. The insulation sheath 64 moves with slight play in and out of one of the exiting boreholes 66 in the facing side of the nozzle holder 26. The borehole changes into a borehole with smaller cross section as it passes through a shoulder collar ring 68. The smaller borehole extends lengthwise through the nozzle holder 26 and issues to the outside through a plane surface 72 built into the outer wall.

The uninsulated end of a connecting wire 74 is soldered into each of the contact studs 62. The connecting wire 74 extends through the borehole 70, and a portion thereof projects for some distance out of the nozzle holder 26 and is provided with lead-away extension contacts 76. A bracket 78, one end 80 of which is supported against a shoulder surface 82 of the nozzle holder 26, has been provided for sealing the borehole 70, the other end 84 of the bracket 78 is tensioned against two elastic stops 88, by means of a screw 86. The stops 88 each have a connecting wire 74 running through them, each of them, in addition, is stopped against a conical-shaped support surface 90 built into the borehole exit 70 in the plane surface 72. The desired sealing of the boreholes 70 will be accomplished by means of the axial compression exerted by the bracket 78, and the stops 88 on the connecting wires 74 being radially pressed against the support surfaces 90. The weld joints of the prongs with the studs 62 are stress-relieved by the installation of the insulation sheath 64 on the shoulder collar rings 68. The recess 58 is additionally sealed from the outside.

The example of the preferred embodiment described here for an injection nozzle has the advantage that between the prongs 56 of the induction coil 44 and the extension connecting contacts 76, there is neither pressure contacts nor plug contacts, so that there is on the whole only a small line resistance. The section of the connecting wire 74 projecting out of the nozzle holder 26 is dimensioned in such a way that the nozzle holder 26 may be lifted away from spacer plate 24 at a proper distance enabling the disassembly of the locking spring 52. In this way, it is possible for the nozzle to be easily constructed without the separate construction of provisions for contact, making it possible to assure control of the opening pressure by the insertion of close tolerance washers 54 of various thicknesses. As an initial assembly of the injection nozzles, the components are first of all fitted together without the attached connecting contacts 76, which are then mounted during the final assembly.

Figure 3:
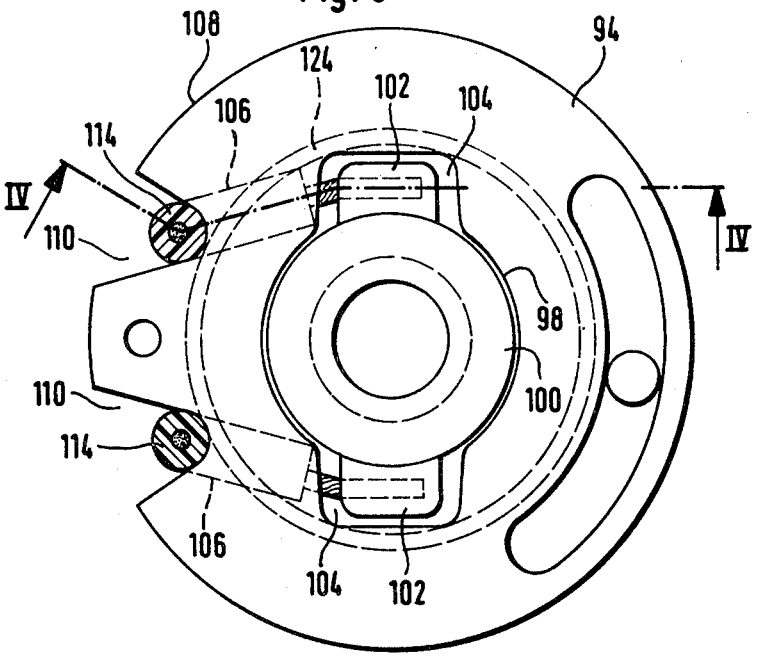
FIG. 3 is a top view of the preassembled spacer plate of a second preferred embodiment.
Figure 4:
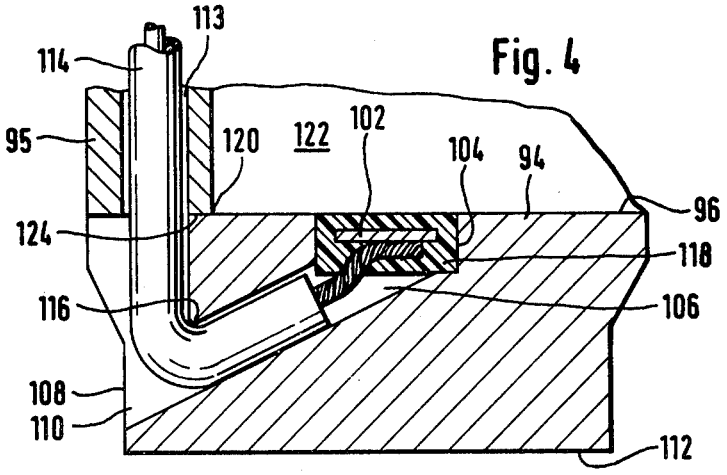
FIG. 4 is a section along the line IV—IV in FIG. 3.

A spacer plate 94 is provided for the preferred embodiment according to FIGS. 3 and 4. The spacer plate 94 has its facing side 96 opposite and turned toward the nozzle holder 26. This facing side has a centrally disposed depression 98 for fitting the induction coil 100. For this, two connected contact prongs 102 are molded together with the ends of the coil winding. The prongs 102 are diametrically and laterally disposed at some distance from the coil body and placed opposite to it. Each contact prong 102 is embedded in a recess 104 on the facing side 96 of the spacer plate 94. A channel 106 leads in a slant-wise direction from each recess 104 downward to the casing circumference 108 beyond the spacer plate 94, where each channel 106, each having a longitudinal slot 110, issues into the casing circumference. None of the longitudinal slots 110 leads through to the lower facing side 112, so that this facing side is not broken, and the spacer plate, after assembling the injection nozzle, provides a cover for the ring channel serving for fuel supply in the contiguous facing side of the nozzle body. Further, the radial spacing of the bottom surface of the longitudinal slots 110 is chosen with respect to the nozzle axis in such a way that after assembly of the components, the longitudinal slots overlap with the boreholes 113 provided in the nozzle holder 95 for conducting the connecting wires 114. Instead of the boreholes 113, it would also be possible to provide longitudinal slots in the casing of the nozzle holder 95.

The connecting wires 114 are led through the longitudinal slots 110 and the channels 106, and are welded or soldered onto the prongs 102 of the induction coil 100. After assembly of the components, the connecting wires 114 will be pressed against the mouth of the channel 106 in the longitudinal slot 110. By means of the sharp bend in the contact wire 114 on the edge 116 of the housing, tension on the junction of the connecting wire with the prongs 102 will be relieved. In addition, other means may be provided on the nozzle holder 95 for relieving tension. After connecting the contact prongs 102 with the connecting wires 114, the recesses 104 in the spacer plate 94 will be plugged and sealed with a so-designated material, so that the junction points for the components will not be disturbed during retouching surface finishing processes carried out on the facing side 96, for instance, lapping processes, and the space for the coil and the cable lead channel will be sealed off from the chamber 50.

The preferred embodiment according to FIGS. 3 and 4 has the advantage that the connecting wires 114 pass around the close tolerance plate 124, indicated in FIG. 3 with the broken line, constructed between the nozzle holder 95 and the spacer plate 94 and in direct contact with the aperture rim 120 of the spring chamber 122, so that this close tolerance plate 124 is not cut or notched in any place, and the component is perfectly sealed.

Figure 6:
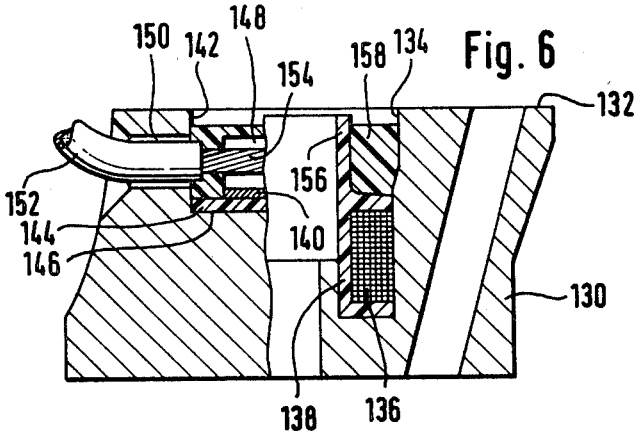
FIG. 6 shows a section through the line VI—VI in FIG. 5.
Figure 5:
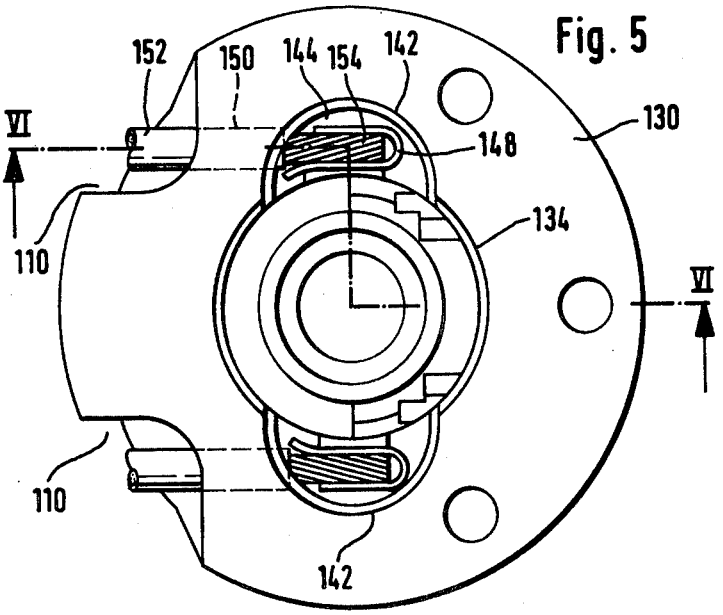
FIG. 5 shows, in accordance with FIG. 3, a top view of the preassembled spacer plate of the third example of the preferred embodiment.

In the example of the preferred embodiment according to FIGS. 5 and 6, a spacer plate 130 is provided, whose facing side 132 opposite and facing toward the nozzle holder is provided with a centrally disposed depression 134 for fitting an induction coil 136. Two metallic contact prongs 140 connected with the ends of the coil winding are molded in the coil body 138 of the induction coil 136, said prongs 140 disposed at some distance diametrically and laterally opposite the coil body 138. Each contact prong 140 is embedded in a depression/recess 142 in the facing side 132 of the spacer plate 130. Two diametrically disposed flange extensions 144 opposite each other are formed on the coil housing 138, and the contact prongs 140 are fitted above the flange extensions 144 and are extended into the recesses 142 designed for them, where they are fitted on the bottom surfaces 146 of the recesses 142.

Each contact prong 140 is provided on its upper face with an upright solder or weld extension 148, which has the shape of an open eyelet opening onto one side. A borehole 150 opens into each recess 142 from this side, through said borehole a connection wire 152 being led and whose uninsulated end 154 extends between the two legs of the solder or weld extensions 148 of the contact prongs 140. The coil housing 138 is, further, provided on its upper end with a ring collar 156, which extends upward in the area of the upper facing side of the spacer plate 130. The space for the ring between the wall of the depression 134 and the ring collar 156, as well as the recesses 142 in the spacer plate, are tightly sealed with an insulating sealing compound 158.

The preferred embodiment according to FIGS. 5 and 6 has in addition, and above all, the advantage that the connecting wires 152 pass around the close tolerance plate between the spacer plate 130 and the nozzle holder, so that this surface is neither notched nor cut in any place and the components may be perfectly sealed. This design has in addition, however, the further advantage that the induction coil 136 is mounted before connecting the connecting wires 152 in the spacer plate 130, and it is possible to anchor it there permanently, according to which the connections leading from above can be easily manufactured. In addition, the flange extensions 144 of the coil housing 138 prevent solder from dropping onto the bottom surface 146 of the spacer plate 130, thus preventing accidental grounding. By means of designing the contact prongs 140 as ring eyelets, the further advantage is also realized that the connecting wires 152 are isolated from the soldering or welding in the eyelets and may be maintained in their prescribed positions during the connection operation. During sealing of the components, the sealing compound 158 flows downward without restriction onto the contact points, so that the contact points are perfectly isolated and insulated.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines, comprising;

a nozzle holder having a chamber;

a nozzle body tensioned against the nozzle holder, and defining a nozzle opening;

a tensioned spacer plate location between the nozzle body and the nozzle opening;

a locking spring located in the nozzle body chamber;

a valve needle disposed in the nozzle body and loaded by the locking spring toward the nozzle opening;

an induction coil mounted in the tension spacer plate;

two laterally disposed contact prongs connected to the induction coil;

securing means electrically connecting one end of a pair of connecting wires extending through the nozzle holder one each to a respective one of the contact prongs disposedly connected to said induction coil;

said nozzle holder defines an aperture rim of the chamber and includes a lead-through borehole for each connecting wire, said spacer plate includes clearance spaces and interconnected channels, the channels extending from a respective clearance space to the junction point of a contact prong and connecting wire, said respective clearance space and channel together extending around the aperture rim, and respective clearance spaces and channels communicate with a respective lead-through borehole;

said junction points for the connecting wires and their respective contact prong are located on the side of the contact prong opposite to and turned away from the nozzle body; and said junction points of the contact prongs are embedded in the facing surface of the spacer plate, and the junction points of the contact prongs are fused to respective connecting wires.

2. The fuel injection nozzle as defined in claim 1, further comprising:

connecting contact connected to a respective one of the connecting wires opposite to the electrically connected end of the connecting wires, wherein the connecting wires extend outwardly from the nozzle holder to such an extent that the nozzle holder is displaceable relative to the spacer plate for enabling disassembly of the locking spring.

3. The fuel injection nozzle as defined in claim 1, further comprising:

tension relieving means for relieving tension at the securing means.

4. The fuel injection nozzle as defined in claim 1, wherein the clearance spaces are constructed as longitudinal slots in the spacer plate casing circumference.

5. The fuel injection nozzle as defined in claim 4, wherein the intersection of the channels and the longitudinal slots define an acute angle.

6. The fuel injection nozzle as defined in claim 1, wherein the contact prongs are each provided with a bent weld extending upward off the plane of the prong.

7. The fuel injection nozzle as defined in claim 6, wherein the bent weld extends upward to one of the outward opening eyelets opposite the respective channel.

8. The fuel injection nozzle as defined in claim 1, wherein the contact prongs are each provided with a solder extension extending upward off the plane of the prong.

9. The fuel injection nozzle as defined in claim 8, wherein the solder extension extends upward to one of the outward opening eyelets opposite the respective channel.

10. The fuel injection nozzle as defined in claim 1, wherein the induction coil includes a body provided with flange extensions which are secured to the underside of a respective contact prong, said flange extensions insulating the contact prongs away from the spacer plate.

11. The fuel injection nozzle as defined in claim 1, wherein the induction coil includes a body provided with a ring collar projecting axially over the contact prongs, the facing side of said ring collar lying in a common plane with the unembedded section of the facing surface of the spacer plate.

12. The fuel injection nozzle as defined in claim 1, wherein the nozzle holder includes a lead-through borehole for each connecting wire, which is constructed as a longitudinal slot.

13. The fuel injection nozzle as defined in claim 1, wherein said securing means comprise a weld.

14. The fuel injection nozzle as defined in claim 1, wherein said securing means comprise soldering.

15. The fuel injection nozzle as defined in claim 2 further comprising:

tension relieving means for relieving tension at the securing means.

16. A fuel injection nozzle for internal combustion engines, comprising, a nozzle holder having a chamber;

a nozzle body tensioned against the nozzle holder, and defining a nozzle opening;

a tensioned spacer plate located between the nozzle body and the nozzle holder;

a locking spring located in the nozzle body chamber;

a valve needle disposed in the nozzle body and loaded by the locking spring toward the nozzle opening;

an induction coil mounted in the tension spacer plate;

two laterally disposed contact prongs connected to the induction coil;

securing means electrically connecting one end of connecting wires extending through the nozzle holder firmly to a respective one of the contact prongs disposedly connected to said induction coil;

tension relieving means for relieving tension at the securing means, and the nozzle holder includes a shoulder surface, said nozzle further comprising;

flexible stoppers; and a flexed bracket provided for relieving tension, said bracket supported at one end on the shoulder surface and at the other end being axially tensioned against said elastic stoppers by means of a screw, said flexible stoppers each receiving therethrough a connecting wire, and each flexible stopper being supported on a close tolerance surface surrounding the lead-through borehole.

* * * * *